US011826002B2

(12) United States Patent
Lutz et al.

(10) Patent No.: US 11,826,002 B2
(45) Date of Patent: Nov. 28, 2023

(54) DOMESTIC APPLIANCE WITH AT LEAST ONE HEATER FOR A TUBULAR PIECE, THROUGH WHICH A FLUID FLOWS

(71) Applicant: BSH Hausgeräte GmbH, Munich (DE)

(72) Inventors: Stephan Lutz, Zusamaltheim (DE); Stefan Pollithy, Forheim (DE); Markus Wecker, Gundremmingen (DE)

(73) Assignee: BSH Hausgeräte GmbH, Munich (DE)

( * ) Notice: Subject to any disclaimer, the term of this patent is extended or adjusted under 35 U.S.C. 154(b) by 510 days.

(21) Appl. No.: 17/040,561

(22) PCT Filed: Apr. 10, 2019

(86) PCT No.: PCT/EP2019/059109
§ 371 (c)(1),
(2) Date: Sep. 23, 2020

(87) PCT Pub. No.: WO2019/197479
PCT Pub. Date: Oct. 17, 2019

(65) Prior Publication Data

US 2021/0038050 A1 Feb. 11, 2021

(30) Foreign Application Priority Data

Apr. 10, 2018 (DE) ..... 10 2018 205 338.3
Apr. 10, 2018 (DE) ..... 20 2018 001 817.1

(51) Int. Cl.
*A47L 15/42* (2006.01)
*D06F 39/04* (2006.01)
*F24H 1/12* (2022.01)

(52) U.S. Cl.
CPC ..... *A47L 15/4285* (2013.01); *D06F 39/04* (2013.01); *F24H 1/121* (2013.01)

(58) Field of Classification Search
CPC .. A47L 15/4225; A47L 15/4285; D06F 39/04; D06F 39/085; F24H 1/10;
(Continued)

(56) References Cited

U.S. PATENT DOCUMENTS

2005/0199610 A1* 9/2005 Ptasienski ..... H05K 3/1241 219/539
2012/0138096 A1* 6/2012 Tuller ..... A47L 15/488 134/105
2015/0086325 A1 3/2015 Albert et al.

FOREIGN PATENT DOCUMENTS

DE 102011002861 A1 * 7/2012 ..... A47L 15/0049

OTHER PUBLICATIONS

Machine Translation of Lutz et al., DE-102011002861-A1, Jul. 2012. (Year: 2012).*

(Continued)

*Primary Examiner* — David G Cormier
(74) *Attorney, Agent, or Firm* — Michael E. Tschupp; Andre Pallapies; Brandon G. Braun

(57) ABSTRACT

A water-conducting household appliance includes a channel section heatable from outside and configured for passage of fluid in a flow direction. A plurality of electrically interconnected heat conductor elements are provided for executing a heating action. The heat conductor elements are configured to at least partly surround the channel section on the outside, with at least one of the heat conductor elements generating during operation a surface output that varies over its course, resulting in different surface temperatures at a thermal transition into the channel section over its course, wherein the heat conductor elements are arranged such that the surface outputs of the heat conductor elements that follow one another over a circumference of the channel section differ across the flow direction.

26 Claims, 6 Drawing Sheets

(58) Field of Classification Search
CPC . F24H 1/101; F24H 1/102; F24H 1/12; F24H 1/121; F04D 29/588; H05B 2203/013
See application file for complete search history.

(56) References Cited

OTHER PUBLICATIONS

International Search Report PCT/EP2019/059109 dated Jul. 2, 2019.

* cited by examiner

DOMESTIC APPLIANCE WITH AT LEAST ONE HEATER FOR A TUBULAR PIECE, THROUGH WHICH A FLUID FLOWS

CROSS-REFERENCES TO RELATED APPLICATIONS

This application is the U.S. National Stage of International Application No. PCT/EP2019/059109, filed Apr. 10, 2019, which designated the United States and has been published as International Publication No. WO 2019/197479 A1 and which claims the priorities of German Patent Applications, Serial Nos. 10 2018 205 338.3, filed Apr. 10, 2018, and 10 2018 001 817.1, filed Apr. 10, 2018, pursuant to 35 U.S.C. 119(a)-(d).

BACKGROUND OF THE INVENTION

The present invention relates to a water-conducting household appliance, for example a dishwasher, in particular a household dishwasher, with at least one channel section which can be heated from the outside and through which fluid can flow in a flow direction, with a plurality of electrically interconnected heat conductor elements being provided for heating purposes, which at least partly surround the channel section on the outside and input surface outputs into the channel section during operation (according to the preamble of claim 1).

For such water-conducting household appliances it is particularly important that heat is dissipated from the heater in a uniform manner by flowing fluid to ensure correct operation without excessively high temperatures resulting at the heater. As some users fail to operate a household dishwasher for example as intended with salt when softening using detergent and rinse aid, omitting, for example forgetting, at least one of said components, the dishwasher chemistry is no longer balanced. Deposits can then form at the heater, impeding the transfer of energy to the fluid, which generally causes partial overheating of a heat conductor. This then generally results in a defective heater.

Such user behavior means that the formation of deposits cannot be completely avoided.

BRIEF SUMMARY OF THE INVENTION

It is the object of the invention to extend the service life of the heater and avoid defects where possible.

Because, according to the invention, the or each heat conductor element generates surface outputs that vary over its course, in particular electrical surface outputs, resulting in different surface temperatures at the thermal transition into the channel section over its course, and heat conductor elements with different, in particular electrical, surface outputs follow one another, in particular adjoin one another, in particular on a line across, in particular perpendicular to, the flow direction of the fluid in the channel section over the circumference of the channel section, surface heating results that is divided or segmented into as many sub-regions with different surface outputs as possible. As a result the boundary wall of the channel section, on which said segmented surface heating is provided, is subject to different thermal surface loads below the heat conductor elements corresponding to said sub-regions of locally varying surface outputs, so that when deposits build up on the inner wall surface of the channel sections along which fluid flows, the deposits form more quickly at points with a higher thermal surface load than at points with a lower surface load. Also the different temperature loads of the surface sub-regions of the inner wall of the channel section along which fluid flows and on the outside of which the heat conductors are preferably positioned cause the adhesion of the deposits to the side of the support, for example the steel tube, holding the heating elements to be broken at an early stage due to the different thermal expansion and therefore associated material stresses of the support, for example the steel tube, holding the heating elements, so the deposits flake off the support. The variation of surface outputs in the circumferential direction also prevents a continuous ring of deposits building up over the circumference.

In so far as the or each heat conductor element varies the electrical surface output in the region of 10 W/cm$^2$ to 120 W/cm$^2$, in particular 20 W/cm$^2$ to 80 W/cm$^2$, particularly preferably 35 W/cm$^2$ to 75 W/cm$^2$, a large electrical surface output bandwidth results so the temperature differences and therefore the conditions for the build-up of lime-based deposits in the channel section flowed through differ significantly. The higher the surface temperature in the channel section, the more rapidly the deposits form and therefore the more rapidly the thickness of said deposits also increases. The invention therefore considerably reduces the build-up of large, continuous deposits, clearly reducing susceptibility to error and extending service life.

In particular the channel section is enclosed by a circumferentially closed tubular piece, made of steel for example. The tubular piece is preferably cylindrical, in particular in the shape of a circular cylinder. The thermal expansion of the material of the tubular piece, in particular steel, here is a function of the local temperature, with the result that the hotter regions expand more than the cooler regions. This results in more stress in the material, in particular steel, and on its inward facing surface along which fluid flows, resulting in microdeformation. This in turn encourages deposits to flake off at as early a stage as possible and in the smallest flakes possible. Hotspots, in other words local overheating points, are thus avoided. The risk of heat conductor elements burning through is therefore significantly reduced.

The fluid to be heated flows through the inside of the tubular piece, in particular the tubular section, along its longitudinal extension. An electrical insulation layer is preferably applied to the outer lateral surface of the tubular section, if the support material of the tube is made of an electrically conductive material such as preferably steel. The heat conductor elements are then attached to the outside of this electrical insulation layer. A cover layer, for example a glass layer, is then expediently applied as an outer layer to the support tube with the electrical insulation layer and the heat conductors.

The tubular piece or tubular section preferably extends substantially longitudinally, in particular largely in a straight line. The fluid flows through this tubular piece with a direction component substantially along the longitudinal extension of said tubular piece.

In particular the respective heat conductor extends from the entrance region to the exit region of the tubular piece.

The heating elements preferably each have a course with a component, in particular a main component, in the longitudinal direction of the channel section or in a flow direction of the fluid. In particular the course of their center line is longitudinal. In some instances they can also be helical or can run at an angle, preferably roughly between 0.1° and 30°, to the central axis of the channel section.

They preferably extend substantially from the entrance to the end of the channel section (viewed in a flow direction of the fluid). They are also expediently distributed around the outer circumference of the channel section.

To achieve the abovementioned variation of surface load, in one advantageous development differently shaped heat conductor elements can be provided in a structurally simple manner and can be distributed over the circumference of the channel section, the different shapes also changing in outline parallel to a flow direction of the fluid.

The shapes of heat conductor elements are preferably complementary to one another allowing a maximum surface of the circumference of the channel section to be covered with heat conductor elements.

The respective heat conductor preferably has the geometric shape of an extended trapezoid. A heat conductor that tapers from the entrance of the tubular section to the exit of the tubular section is followed in the circumferential direction by an adjacent heat conductor that complements the previous heat conductor by widening from the entrance of the tubular section to the exit of the tubular section.

In one simple and effective configuration each second heat conductor element shape tapers parallel to the flow direction of the fluid and each heat conductor element shape adjacent thereto widens parallel to the flow direction.

When the conductor paths narrow or widen continuously over the longitudinal course, a path width variation of up to 3:1, in particular up to 2:1 or a little below is favorable.

This allows the distance perpendicular to the flow direction between the adjacent shapes in the flow direction of the fluid to be constant and small, for example with between 0.4 and 5 millimeters in between, to cover the surface with as many heat conductors as possible. In particular at least 85% of the circumferential surface of the channel to be heated, in other words its lateral surface extending in the flow direction, is covered with heat conductor elements here. To this end the cited distance is smaller than the transverse extension of a respective heat conductor at this point.

In particular for major heat induction into the fluid at least 85% of the circumference of the tubular section or tubular piece (i.e. heating tube) is covered with heating elements, in particular its overall longitudinal extension substantially. This ensures a large surface output, in other words major heat input into the channel section. Surface output here refers to the heat output per surface inducted into a wall region surrounding the channel section.

It is particularly favorable if at least some of the heat conductor elements are connected electrically parallel to one another so that if one heat conductor element fails, those adjacent remain unaffected.

Two electrical conductor paths running in the circumferential direction of the channel section are preferably provided on the outside to supply two electrical potentials to both ends of the respective heat conductor. The first electrical conductor path for the first electrical potential is preferably provided around the start of the tubular piece and the second electrical conductor path for the second electrical potential is preferably provided around the end of the tubular piece in the flow direction of the fluid. The heat conductors extend respectively between these two conductor paths or their potentials.

In particular the channel is enclosed by a circumferentially closed tubular piece. The plurality of heat conductors is attached to the outside of this tubular piece. A thick film heater in particular can be attached to the outside of the tubular piece for a highly effective transfer of heat to the fluid flowing in the tubular piece.

It is favorable if the fluid can be heated by way of an integrated heat pump, in which a tubular piece is provided with an outer heater, in particular a thick film heater.

It is particularly advantageous for the heater, in particular the thick film heater, to be formed with a plurality of heat conductors connected parallel to one another, which form single heating resistors, the heat conductor path widths of which vary over their longitudinal course. To be highly effective, each heat conductor has a considerable longitudinal extension compared with its widthwise extension and is arranged substantially in the flow direction of the fluid.

In addition to or independently of the variation of the widths of the heat conductors when viewed along their longitudinal course and across, in particular perpendicular thereto, when viewed over the circumference of the channel section, it may in some instances be expedient for the electrical surface outputs of the heat conductors or heat conductor elements or the thermal surface loads brought about by the heat conductors to be varied along their course and across, in particular perpendicular to, the flow direction, in particular over the circumference of the channel section, by different layer thicknesses, different heat conductor materials, or by other parameters influencing the electrical surface output or heat output.

Other developments of the invention are set out in the subclaims.

The advantageous configurations and developments of the invention described above and/or set out in the subclaims can be applied individually or in any combination, except for example in cases of unambiguous dependency or irreconcilable alternatives.

BRIEF DESCRIPTION OF THE DRAWINGS

The invention and its advantageous configurations and development, as well as their advantages, are described in more detail in the following with reference to drawings of schematic outlines showing exemplary embodiments, in which.

DETAILED DESCRIPTION OF EXEMPLARY EMBODIMENTS OF THE PRESENT INVENTION

Figure 1:
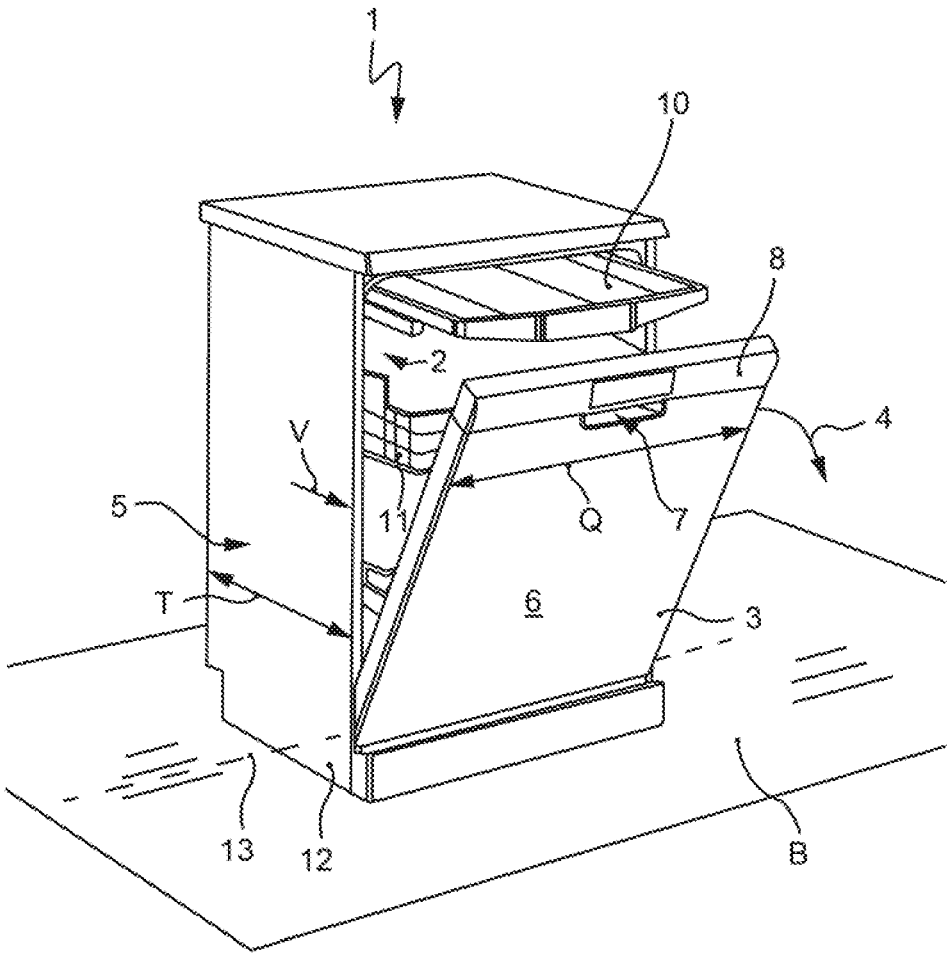
FIG. 1 shows a schematic perspective view obliquely from the front of a water-conducting household appliance, in this instance a dishwasher with a front door and a wash container in the interior.
Figure 2:
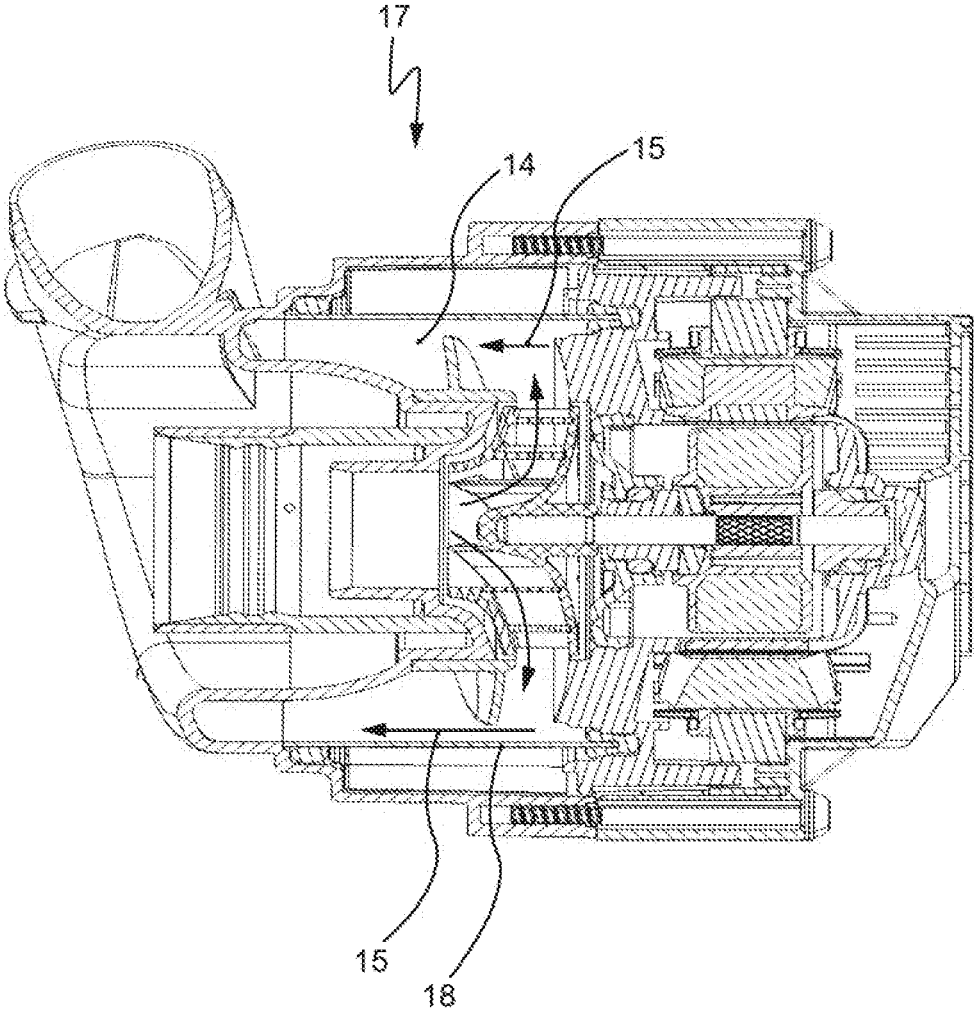
FIG. 2 shows a detailed view of a heat pump arranged in the base of the household appliance for combined fluid transportation and heating.
Figure 3:
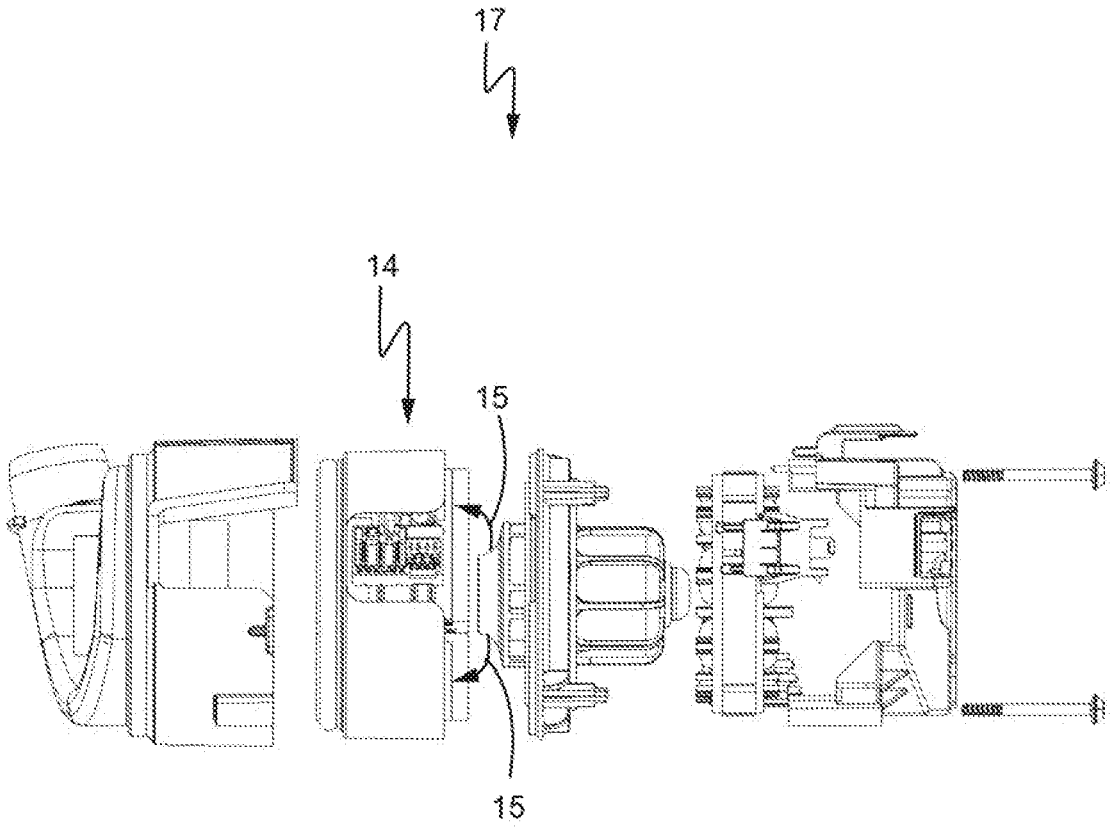
FIG. 3 shows an exploded view of the parts of the heat pump shown in FIG. 2.

The water-conducting household appliance 1 shown schematically in FIG. 1 here is a dishwasher, specifically a household dishwasher. A washing machine or other appliances, in which a fluid is heated, for example a coffee machine, is also possible.

Corresponding parts are shown with the same reference characters in the figures below. Only the component parts of a dishwasher that are necessary in order to understand the invention are described and assigned reference characters here. It goes without saying that the inventive dishwasher can comprise further parts and assemblies.

The dishwasher shown here has a wash container 2 for holding items to be washed, such as dishes, pots, flatware, glasses, cooking utensils, and similar as a component part of an appliance body 5 that is partly open to the outside or closed. The items to be washed can be held here for example in loading units 10, 11, according to the drawing specifically in racks 11 and/or a flatware drawer 10, being subjected to the action of what is known as wash liquor in the process. Two racks 11 are arranged one above the other here by way of example and an additional flatware drawer 10 is arranged in the upper region of the wash container 2. This arrangement is not mandatory. The loading units 10, 11 can be configured so that their height can be adjusted automatically for example manually or by motor or so that their height cannot be adjusted. In FIG. 1 the loading units 10, 11 are shown partly pulled out at the front V of the dishwasher, which faces the user in the installed position.

The wash container 2 can have an at least substantially rectangular footprint with a front V facing a user in the operating position. This front V can form part of a row of adjacent kitchen units or, in the case of a standalone appliance, can also not be associated with other units.

The wash container 2 can in particular be closed at this front V by a door or flap 3. Said door 3 therefore allows the wash container 2 to be opened for loading and unloading or to be closed for the dishwashing operation. The front door 3 here can be pivoted for example in direction 4 but this is not mandatory. In FIG. 1 it is shown in a partially opened position and then at an angle to the vertical. In its closed position however it is upright and according to the drawing it can be pivoted forward and down in the direction of the arrow 4 for opening purposes about a lower horizontal axis, which serves as a door hinge axis 13, so that it is at least approximately horizontal in the completely opened position.

On its vertical outer face, which faces the user in the closed position, the door 3 can have a decorative plate 6 for visual and/or haptic enhancement and/or to match surrounding kitchen units.

The dishwasher here is configured as a standalone or what is described as a semi-integrated or even as a fully integrated appliance. In the last instance the appliance body 5 can also be substantially terminated by the outer walls of the wash container 2. A housing enclosing this on the outside can then be dispensed with. A base 12 for holding in particular functional elements, for example also a circulating pump for wash liquor, can be located in the lower region of the dishwasher. This circulating pump can in particular also be heatable, for example at its diffuser chamber, to bring the wash liquor to the temperature required in the respective program step. This then forms a combined heat pump 17.

In the exemplary embodiment in the drawing the movable door 3 is assigned an operating panel 8 extending in the transverse direction Q of the dishwasher in its upper region and this can comprise a grip opening 7, which is accessible from the front V, for opening and/or closing the door 3 manually. It is therefore preferably what is described as a semi-integrated appliance. The dishwasher frequently has an extension of 45, 50 or 60 centimeters in the transverse direction Q. In the depthwise direction T from the front V to the rear the extension is frequently also around 60 centimeters. The values are not mandatory. The dishwasher can stand on an external floor B, which is ideally at least approximately horizontal.

The dishwasher or other household appliance 1 has at least one channel section 14 that can be heated from outside and through which fluid 15 can flow. The fluid 15 here can be for example water, to which detergent, rinse aid and/or a drying agent can be added. In the case of a dishwasher such a fluid is frequently also referred to as wash liquor. To heat the fluid 15 a plurality of electrically interconnected heat conductors 16 are provided, which are attached to a support, for example a tubular piece 18. Said tubular piece 18 can for example enclose the outside of the circumference of the channel section 14, have a symmetrically round cross section and here form an integral part of the heat pump 17, specifically its diffuser chamber. This is not mandatory but it enhances integration and reduces the space requirement and the number of components required.

The heat conductors 16 can be attached for example using a printing process, plasma coating or some other process for forming layers. Each of said layers forms a heat conductor 16. Generally therefore a thick film heater 19 in particular is formed on the outside.

A plurality of heat conductors 16 are present and at least some are connected electrically parallel to one another, each being arranged with a component in the flow direction F of the fluid 15. Two different electrical potentials are formed here over the circumference of the tubular section 18, the heat conductors 16 extending between. Two electrical conductor paths for supplying two electrical potentials to both ends of the respective heat conductors are preferably provided on the outside of the wall of the channel section running in the circumferential direction of the channel section. A first electrical conductor path for the first electrical potential is preferably provided around the start of the tubular piece and a second electrical conductor path for the second electrical potential is preferably provided around the end of the tubular piece in the flow direction of the fluid. The heat conductors extend respectively between these two conductor paths or their potentials. The heat conductors are therefore connected electrically parallel to one another. Therefore if one of the heat conductors 16 fails, the function of the other is not affected. Where there are a large number of heat conductors, adequate functionality is still ensured even after the failure of one, two or three heat conductors. The thermal overloading of an individual heat conductor element 16 therefore no longer causes total heater failure; the heater can continue to run with only low performance loss so the household dishwasher is still able to function.

The heat conductor elements 16 surround the channel section 14 over a substantial part of its outer surface and during operation, when current flows through them, they input surface outputs into the channel section 14. To this end the tubular section 18 enveloping the channel section 14 is subjected to different thermal surface loads by the plurality of heat conductor elements 16 preferably connected electrically parallel to one another with locational variation in their positions on the outside of the tubular section 18. This brings about a heat input at the respective location of the heating element per given heat input surface, for example per 1 $cm^2$ into the sleeve of the tubular section 18 and correspondingly into the channel section 14. However such input is not uniform over the entire surface but is such that the or each heat conductor element 16 generates surface outputs that vary over its course, resulting in different surface temperatures at the thermal transition into the channel section 14 over the course.

In this process the surface input of electrical power and therefore also thermal energy or heat transforms or changes not only over the course of an individual respective heat conductor element 16 parallel to the flow direction but also on a line across, in particular perpendicular to, the flow direction F over the circumference of the channel section 14, as the heat conductor elements 16 also adjoin one another with different surface outputs over the circumference of the channel section.

The input surface outputs therefore vary both in the circumferential direction and in a direction parallel to the flow direction F of the fluid 15.

Variation of the surface output can be achieved in different ways, for example by material transitions within the heat conductor elements or by varying their thickness. The drawing here shows a version in which heat conductor elements 16 of different shapes 16*a*;16*b* are provided and distributed over the circumference of the channel section 14, the different shapes 16*a*;16*b* also changing in outline parallel to the flow direction F of the fluid 15.

FIGS. 4 to FIG. 7 show wedge shapes 16*a*, 16*b*, which widen or taper in a straight line over their longitudinal course.

Figure 8:
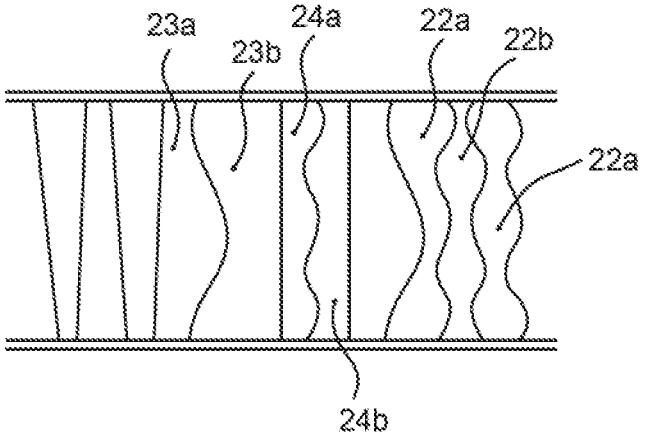
FIG. 8 shows alternative options for coverage of the tubular section with heat conductor elements.

FIG. 8 in contrast shows simply schematically that for example a large wide conductor path can also be divided by a wavy line into two complementary sub-sections 23*a*, 23*b*. The same applies to the conductor path 24*a*, 24*b* shown next to it. Division here is shown by way of a wavy line with multiple curves.

Further to the right in FIG. 8 are opposing wavy lines which delimit the conductor paths 22*a*, 22*b*, 22*a* from one another.

The illustrations in FIG. 8 simply show different embodiments permitted by the invention, which show that the individual shapes of conducting elements do not have to run in a straight line.

For the or each heat conductor element 16 (or even 23*a*, 23*b*, 22*a*, 22*b*) here the surface output varies in the region of 10 W/cm$^2$ to 120 W/cm$^2$, in particular in the region of 20 W/cm$^2$ to 80 W/cm$^2$, particularly preferably in the region of 35 W/cm$^2$ to 75 W/cm$^2$.

Figure 4:
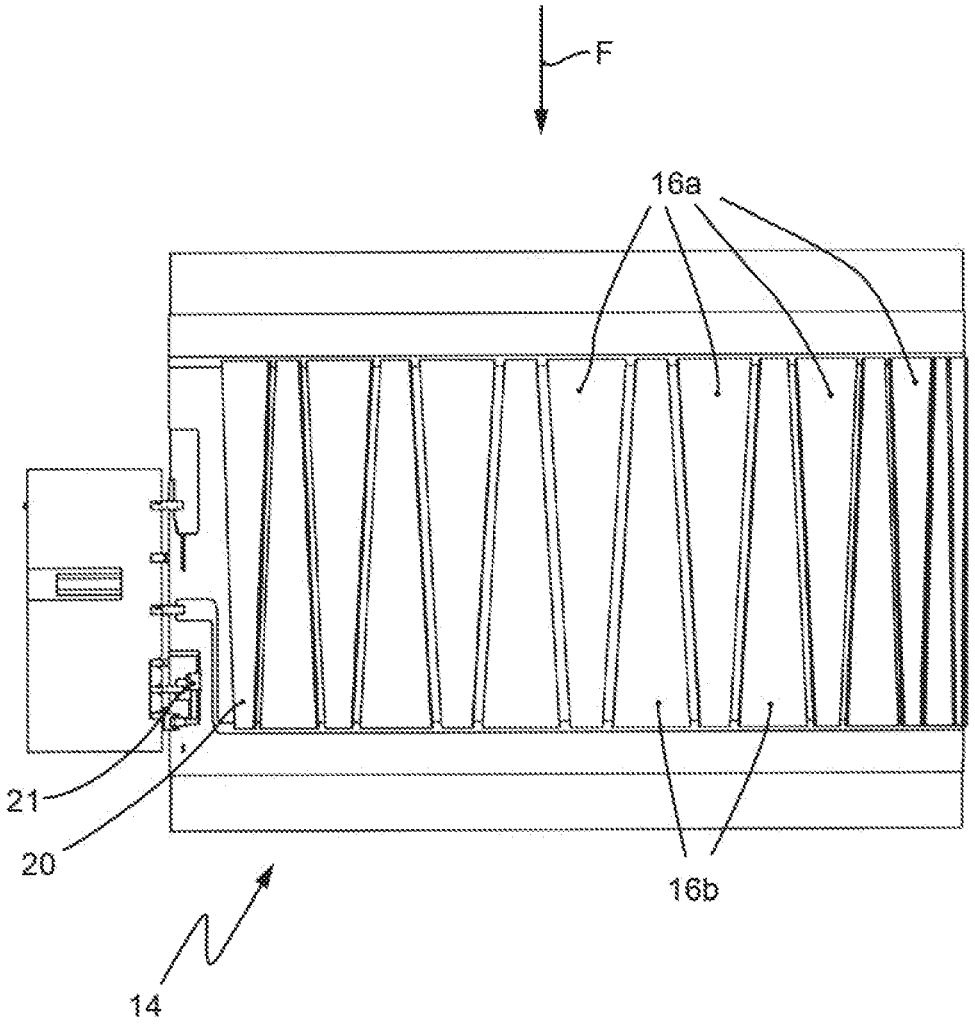
FIG. 4 shows a schematic diagram of individual parts of the heatable tubular section with possible heat conductor element coverage.
Figure 5:
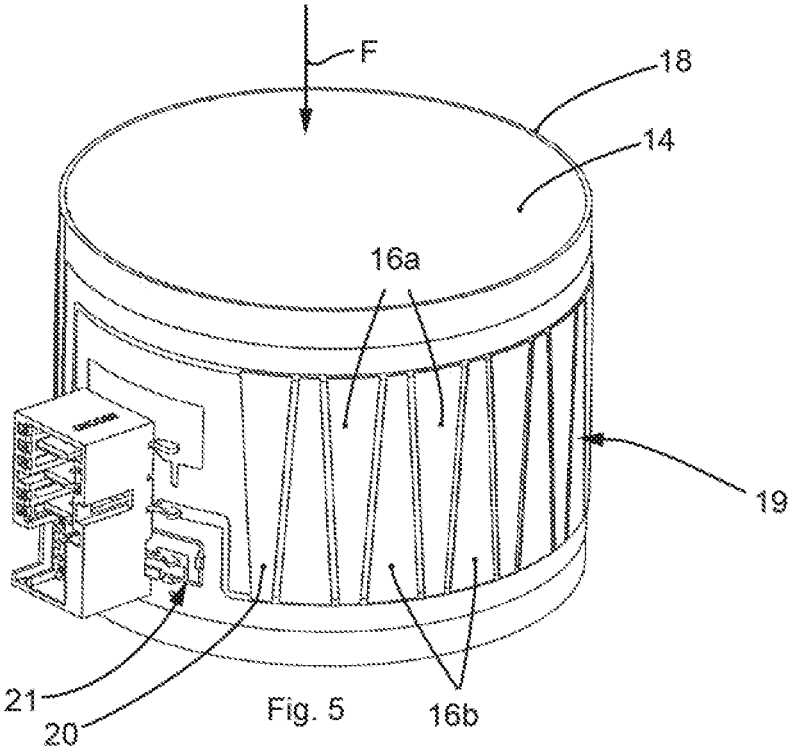
FIG. 5 shows a perspective view of the heatable tubular section with the arrangement of the heat conductor elements from FIG. 4.
Figure 6:
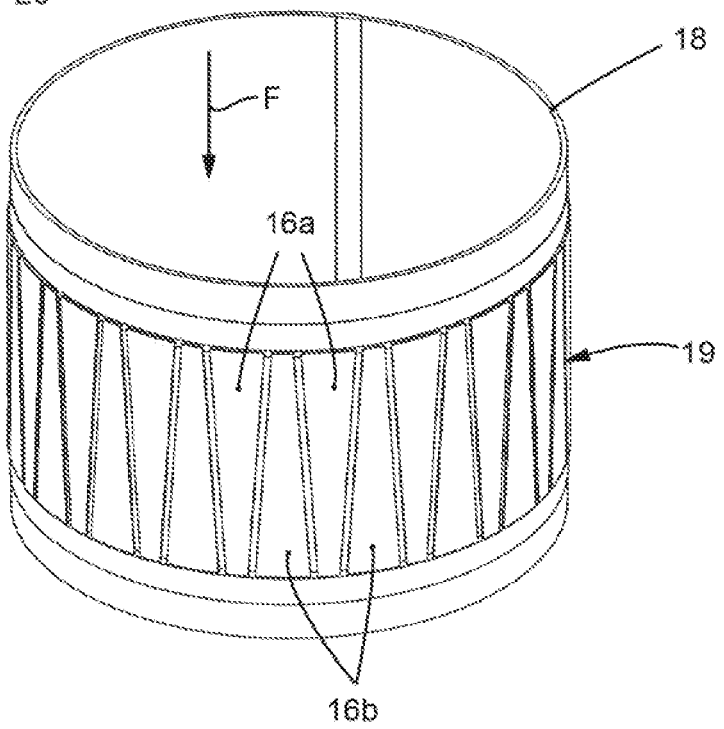
FIG. 6 shows a similar view to FIG. 5, with the view rotated in the circumferential direction of the tubular section compared with FIG. 5.

As shown in FIG. 4 ff., the shapes 16*a*;16*b* of heat conductor elements 16 are configured to complement one another so that a maximum surface of the circumference of the channel 14 is covered with heat conductor elements 16. In total more than 85% of the surface of the circumference of the tubular piece 18 is covered with heat conductor elements 16 thus, so that a high level of effectiveness is achieved. The high coverage density can also be seen in the notionally "unwound" state of the heater in FIG. 7.

The respective heat conductor preferably has a geometric shape in the form of an extended trapezoid. A heat conductor that tapers from the entrance of the tubular section to the exit of the tubular section is followed in the circumferential direction by an adjacent heat conductor that complements the previous heat conductor by widening from the entrance of the tubular section to the exit of the tubular section.

Just two different shapes 16*a*, 16*b* of heat conductor element 16 are provided here. More than two different shapes are also possible. As can be seen clearly in FIG. 5 for example, the first shape 16*a* of heat conductor element 16 tapers parallel to the flow direction F of the fluid 15, while each directly adjacent shape 16*b* of heat conductor element 16 widens parallel to the flow direction F. This path width variation means that the thickness and material composition of the respective heat conductor element 16 can remain constant while still achieving a varying surface load.

Each heat conductor element 16 advantageously has a path width variation of up to 3:1 over its course, in particular of 2:1 or a little below. Halving the width quadruples the output density.

The alternating arrangement of the first and second shapes 16*a*, 16*b* over the circumference of the tubular piece 18 allows the distance perpendicular to the flow direction F between the adjacent shapes 16*a*;16*b* to be kept constant in the flow direction of the fluid 15. This can also be the case for freely formed shapes 22*a*, 22*b* or 23*a*, 23*b* or 24*a*, 24*b* according to FIG. 8, if a wide point of a first shape "engages" in a narrow point of an adjacent further shape there.

The heater, in particular the external thick film heater 19 described above, is in any case formed with a plurality—preferably 10 to 60, in particular 20 to 40—of heat conductors 16 connected parallel to one another, which are arranged next to one another over the circumference. These each form single heating resistors, the heat conductor path widths of which vary over their longitudinal course. According to FIG. 4 to FIG. 7 here the variation is a continuous widening or narrowing parallel to the flow direction F—depending on the shape 16*a* or 16*b*.

Each heat conductor 16 here has considerable longitudinal extension compared with its widthwise extension. This longitudinal extension is at least substantially parallel to the flow direction F of the fluid 15. This direction also determines the arrangement of the heat conductors 16.

Figure 7:
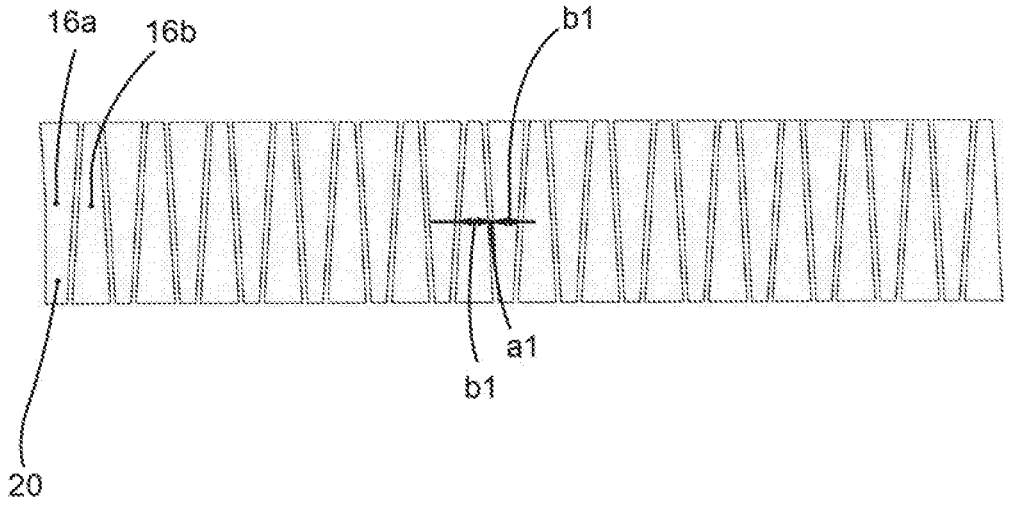
FIG. 7 shows two simply schematic views representing the notion of the heat conductors "unwound" from the circumference of the tubular section.

The heat conductors 16 are at a short distance al of between 0.4 and 5 millimeters from one another in the transverse direction perpendicular to the flow direction F in order to be able to achieve a high coverage density with heat conductors 16 over the circumference, as shown for example in the notionally unrolled diagram in FIG. 7.

This distance al is smaller than the transverse extension b1 of a respective heat conductor 16 at this point.

It is clear from FIG. 4 for example that a narrow region 20 with a high thermal surface load, in other words with a large heat input into the tubular piece 18, is arranged in proximity to a temperature sensor system 21, so that, when deposits form, they preferably form at this point. This allows deposit detection to be performed easily with the aid of a temperature sensor system 21.

The geometric manifestation here should be such that the region 20 with roughly the highest surface output is located in proximity (distance less than 10 millimeters) to the temperature sensor system 21.

Overall quality is optimized with regard to service life and robustness is enhanced.

When a number of heat conductors 16 are connected in parallel, the heater 19 can be operated with only slightly reduced output when a heat conductor 16 fails. The greater the number of heat conductors 16, the easier it is to tolerate a possible failure of an individual heat conductor 16.

Very economical implementation of possible deposit detection can be achieved specifically with proximity of a region 20 of high surface output to the temperature sensor system 21.

The invention claimed is:

1. A water-conducting household appliance, comprising:

a channel section heatable from outside and configured for passage of fluid in a flow direction; and a plurality of electrically interconnected heat conductor elements being provided for executing a heating action, said heat conductor elements configured to at least partly surround the channel section on an outside, with a first heat conductor element of the heat conductor elements being configured to generate during operation a first surface output that varies over a longitudinal course of the first heat conductor element, resulting in different surface temperatures at a thermal transition into the channel section over the longitudinal course of the first heat conductor element, wherein the heat conductor elements are arranged in an alternating arrangement of at least the first heat conductor element and a second heat conductor element of the heat conductor elements such that a second surface output of the second heat conductor element that follows the first heat conductor element over a circumference of the channel section differs from the first surface output of the first heat conductor element across the flow direction.

2. The household appliance of claim 1, wherein the heat conductor elements are arranged such that the first surface output and the second surface output differ perpendicular to the flow direction.

3. The household appliance of claim 1, wherein the first heat conductor element of the heat conductor elements varies the first surface output in a region of 10 $W/cm^2$ to 120 $W/cm^2$.

4. The household appliance of claim 1, wherein the first heat conductor element of the heat conductor elements varies the first surface output in a region of 20 $W/cm^2$ to 80 $W/cm^2$.

5. The household appliance of claim 1, wherein the first heat conductor element of the heat conductor elements varies the first surface output in a region of 35 $W/cm^2$ to 75 $W/cm^2$.

6. The household appliance of claim 1, wherein the heat conductor elements have different shapes and are distributed over the circumference of the channel section, with the different shapes changing each an outline thereof parallel to the flow direction of the fluid.

7. The household appliance of claim 6, wherein the shapes of the heat conductor elements are configured to complement one another such that a maximum surface of the circumference of the channel section is covered with the heat conductor elements.

8. The household appliance of claim 6, wherein one of the shapes of heat conductor elements tapers parallel to the flow direction of the fluid and another one of the shapes of heat conductor elements in adjacent relation to the one shape of heat conductor elements widens parallel to the flow direction.

9. The household appliance of claim 1, wherein the first heat conductor element of the heat conductor elements has a path width variation of up to 3:1 over the longitudinal course of the first heat conductor element.

10. The household appliance of claim 1, wherein the first heat conductor element of the heat conductor elements has a path width variation of up to 2:1 over the longitudinal course of the first heat conductor element.

11. The household appliance of claim 6, wherein a distance across the flow direction between adjacent shapes of the heat conductor elements is constant in the flow direction of the fluid.

12. The household appliance of claim 1, wherein at least 85% of a circumferential surface of the channel section to be heated is covered with the heat conductor elements.

13. The household appliance of claim 1, wherein at least some of the heat conductor elements are connected electrically parallel to one another.

14. The household appliance of claim 1, further comprising a dishwasher, said dishwasher comprising a wash container for holding items to be washed, wherein the fluid is a wash liquor and heatable for acting upon the items to be washed, with detergent and/or rinse aid and/or drying agent being added to the wash liquor.

15. The household appliance of claim 1, further comprising a heat pump configured to heat the fluid.

16. The household appliance of claim 1, further comprising a circumferentially closed tubular piece configured to enclose the channel section.

17. The household appliance of claim 16, further comprising a thick film heater attached to an outside of the tubular piece.

18. The household appliance of claim 17, wherein the heater includes the plurality of heat conductor elements connected parallel to one another and forming single heating resistors which have heat conductor path widths that vary over a respective longitudinal course of the plurality of heat conductor elements.

19. The household appliance of claim 18, wherein each heat conductor element of the heat conductor elements has a longitudinal extension which is greater than a widthwise extension thereof.

20. The household appliance of claim 18, wherein the heat conductor elements are arranged substantially in the flow direction of the fluid.

21. The household appliance of claim 18, wherein the heat conductor elements are at a distance of between 0.4 and 5 millimeters from one another in a transverse direction.

22. The household appliance of claim 21, wherein the distance is smaller than a transverse extension of the heat conductor elements.

23. The household appliance of claim 1, wherein 10 to 60 of said heat conductor elements are distributed over the circumference of the channel section.

24. The household appliance of claim 1, wherein 20 to 40 of said heat conductor elements are distributed over the circumference of the channel section.

25. The household appliance of claim 1, further comprising a temperature sensor system, the first heat conductor element including a first region having a first thermal surface load with higher heat input compared to a second thermal surface load of a second region of the first heat conductor element, said first region of the first heat conductor element being arranged in proximity to the temperature sensor system.

26. The household appliance of claim 25, wherein a region with roughly a highest surface output is arranged at a distance of less than 10 millimeters from the temperature sensor system.

* * * * *